United States Patent [19]

Hanley et al.

[11] 4,133,421

[45] Jan. 9, 1979

[54] COIN OPERATED PACKET DISPENSING MACHINE

[76] Inventors: James O. Hanley, 12838 Burwell Dr., Minnetonka, Minn. 55343; Irving F. Snyder, 663-91st Ave., NE., Blaine, Minn. 55434

[21] Appl. No.: 773,803

[22] Filed: Mar. 3, 1977

[51] Int. Cl.[2] ..... B65H 3/06; G07F 11/20

[52] U.S. Cl. ..... 194/57; 194/DIG. 2; 221/232; 221/259; 221/312 R

[58] Field of Search ..... 194/57, 58, 1 G, DIG. 2; 221/259, 311, 312 R, 232, 280, 251

[56] References Cited

U.S. PATENT DOCUMENTS

| | | | |
|---|---|---|---|
| 356,784 | 2/1887 | Pritchard | 221/259 X |
| 425,996 | 4/1890 | Dieterich | 194/58 |
| 439,030 | 10/1890 | Dieterich | 194/DIG. 2 |
| 849,609 | 4/1907 | Grover | 194/57 |
| 1,477,501 | 12/1923 | Keenan | 221/312 R X |
| 1,564,540 | 12/1925 | Dinwiddie | 194/57 UX |
| 1,758,390 | 5/1930 | Curtis | 194/58 UX |
| 3,193,139 | 7/1965 | Iannone et al. | 221/259 X |

FOREIGN PATENT DOCUMENTS

| | | | |
|---|---|---|---|
| 1287810 | 2/1962 | France | 194/57 |

*Primary Examiner*—Robert B. Reeves
*Assistant Examiner*—Francis J. Bartuska
*Attorney, Agent, or Firm*—Burd, Braddock & Bartz

[57] ABSTRACT

A coin-operated machine for vending and dispensing generally flat semi-rigid packets of irregular contour such as those used to package individual size servings of powdered drinks, cocoa, coffee, fruit drinks, etc., dehydrated broths and soups, and the like. The dispenser is especially adapted for use in locations such as offices, employee lunchrooms, school lunchrooms, and the like. The machine is characterized by a reciprocable coin-actuated slide bar provided with a friction member for engaging the lowermost packet in an overlying vertical magazine holding a plurality of packets in stacked relation for gravity feed operation. Deposit of a coin prevents engagement of a locking pawl with the slide bar and permits extension of the slide bar by pulling on an external handle to engage a packet of commodity and discharge it from the machine. The slide bar is spring biased for automatic retraction. Each machine includes one or more dispensing stations. Each dispensing station is operated by one or more coins of the same denomination. A further locking pawl is provided to prevent discharge of more than one packet without deposit of additional coins.

6 Claims, 9 Drawing Figures

-13-

COIN OPERATED PACKET DISPENSING MACHINE

BACKGROUND OF THE INVENTION

This invention is directed to a coin-operated machine for vending and dispensing individual serving sized packets of concentrated food or drink intended to be mixed and diluted with water. It is common practice to package commodities such as cocoa, dried coffee, fruit-flavored drinks of various kinds, dehydrated broths and soups, etc. in generally flat semi-rigid packets. Such packets generally take the form of two sheets of metal foil or paper or synthetic resinous sheet material or laminates of these materials enclosing the concentrate between the sheets and sealed around the four edges. Alternatively, the packet may be formed from a single sheet folded over upon itself and sealed on three edges. In either event, the result is a semi-rigid package which, although generally flat, is of irregular contour and is difficult to stack, the thickness of the center portion of the packet being many times greater than the thickness of the sealed edges. Because of this, it has not heretofore been feasible to vend the products in such packets automatically in coin-operated machines. At the same time, because of the convenience in preparation of an individual serving, the food and beverage products so packaged are becoming increasingly popular and there is demand for means for automatically dispensing such products as in offices, employee lunchrooms, school lunchrooms, and the like. The present invention is directed toward solving the problems of dispensing irregularly shaped packets.

SUMMARY OF THE INVENTION

The coin operated machine according to the present invention for dispensing generally flat semi-rigid packets of irregular shape includes an outer housing within which are one or more dispensing units or stations, each for a different product. Each station includes a vertically disposed column magazine adapted to contain a plurality of irregular shape packets in stacked relation for gravity feeding. The forward bottom edge of each such magazine has a discharge slot through which the lowermost packet may be discharged. The outer housing has a complementary discharge slot through which the packet is delivered to the customer. The packet is discharged by virture of friction means engaging the bottom surface of the lowermost packet in a magazine and sliding it generally horizontally from beneath the remaining packets in the magazine.

The friction means is carried on a reciprocable coinactuated slide bar supported within the housing and connected to a handle on the exterior of the housing. The slide bar includes a vertically disposed coin-receiving slot extending through the slide bar for passage of a coin through the bar. A coin deposit slot in the housing directly overlies the coin-receiving slot and a fixed coin support underlies the coin-receiving slot when the slide bar is in retracted position. A locking pawl engages a recess in the upper edge of the slide bar adjacent to the coin-receiving slot to prevent operation of the machine without use of a coin. However, when a coin is deposited, the locking pawl is prevented from locking engagement with the slide bar. The slide bar may be extended by pulling on the handle and withdrawing a packet of the desired product. Simultaneoulsy, as the slide bar is extended, the coin in the coin-receiving slot is withdrawn from the coin support and drops into a receptacle for collecting the coins. The slide bar is spring biased for automatic retraction. Separate locking pawl means are provided to prevent repeated operation of a dispensing unit without deposit of additional coins.

BRIEF DESCRIPTION OF THE DRAWINGS

The invention is illustrated by the accompanying drawings in which corresponding parts are identified by the same numerals and in which.

Figure 1:
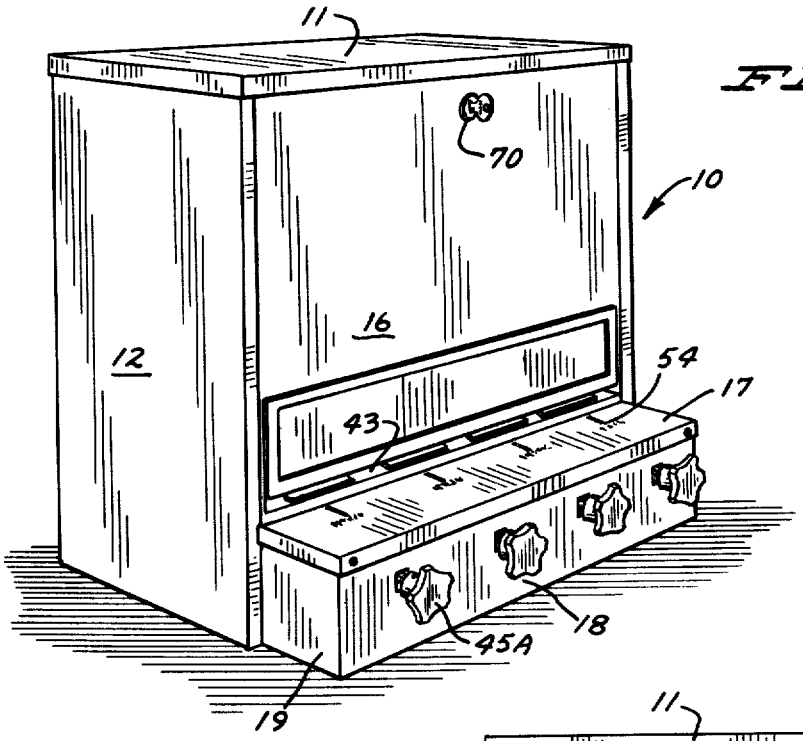
FIG. 1 is a perspective view of the packet dispensing machine according to the present invention.
Figure 2:
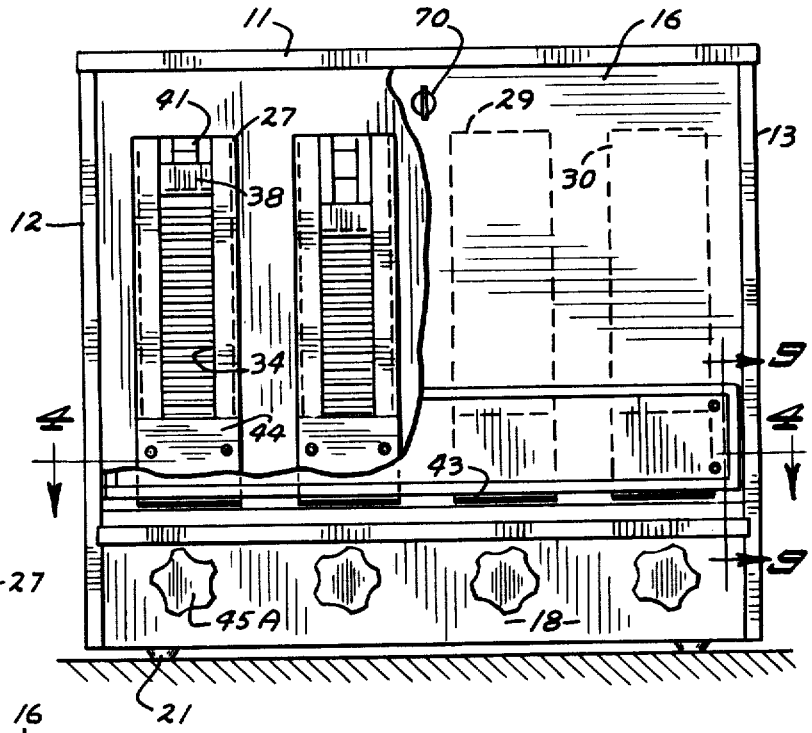
FIG. 2 is a front elevation, partly broken away to reveal interior structure of the dispensing machine.
Figure 3:
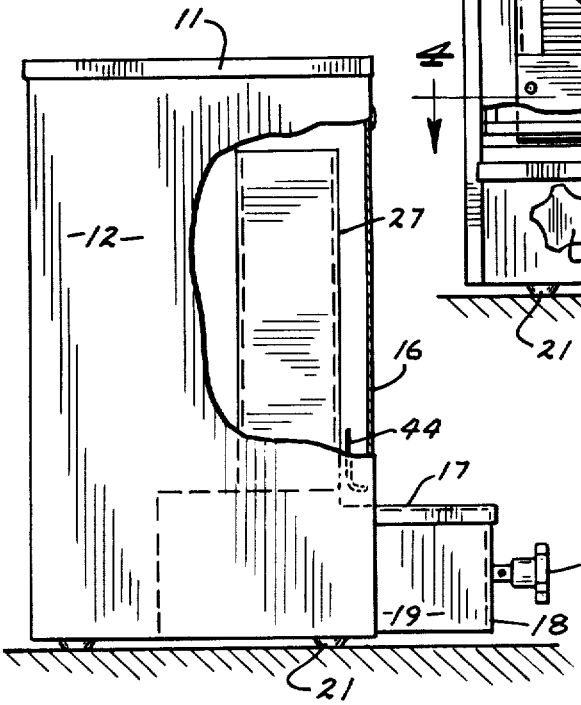
FIG. 3 is a left side elevation, partly broken away to reveal interior structure.
Figure 4:
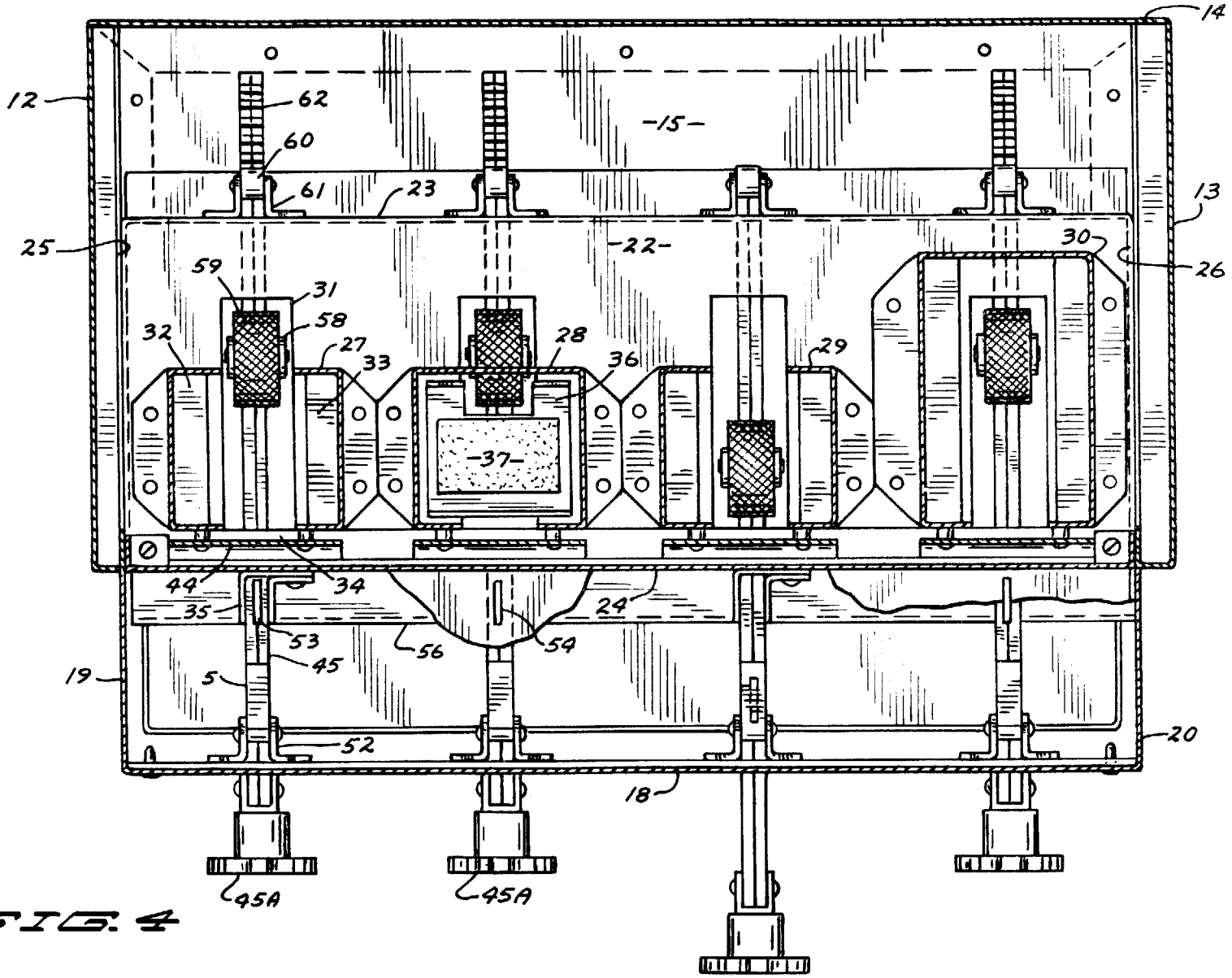
FIG. 4 is a horizontal section on an enlarged scale on the line 4—4 of FIG. 2 and in the direction of the arrows.
Figure 6:
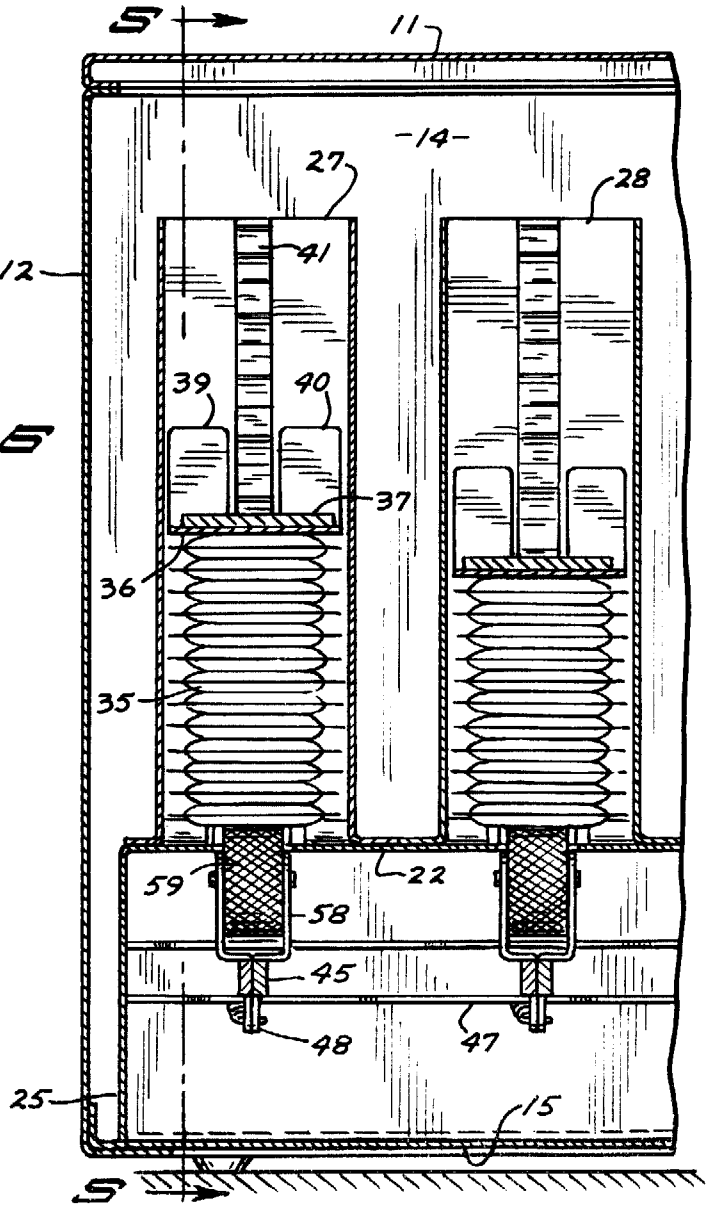
FIG. 6 is a fragmentary section on the line 6—6 of FIG. 5 and in the direction of the arrows.
Figure 5:
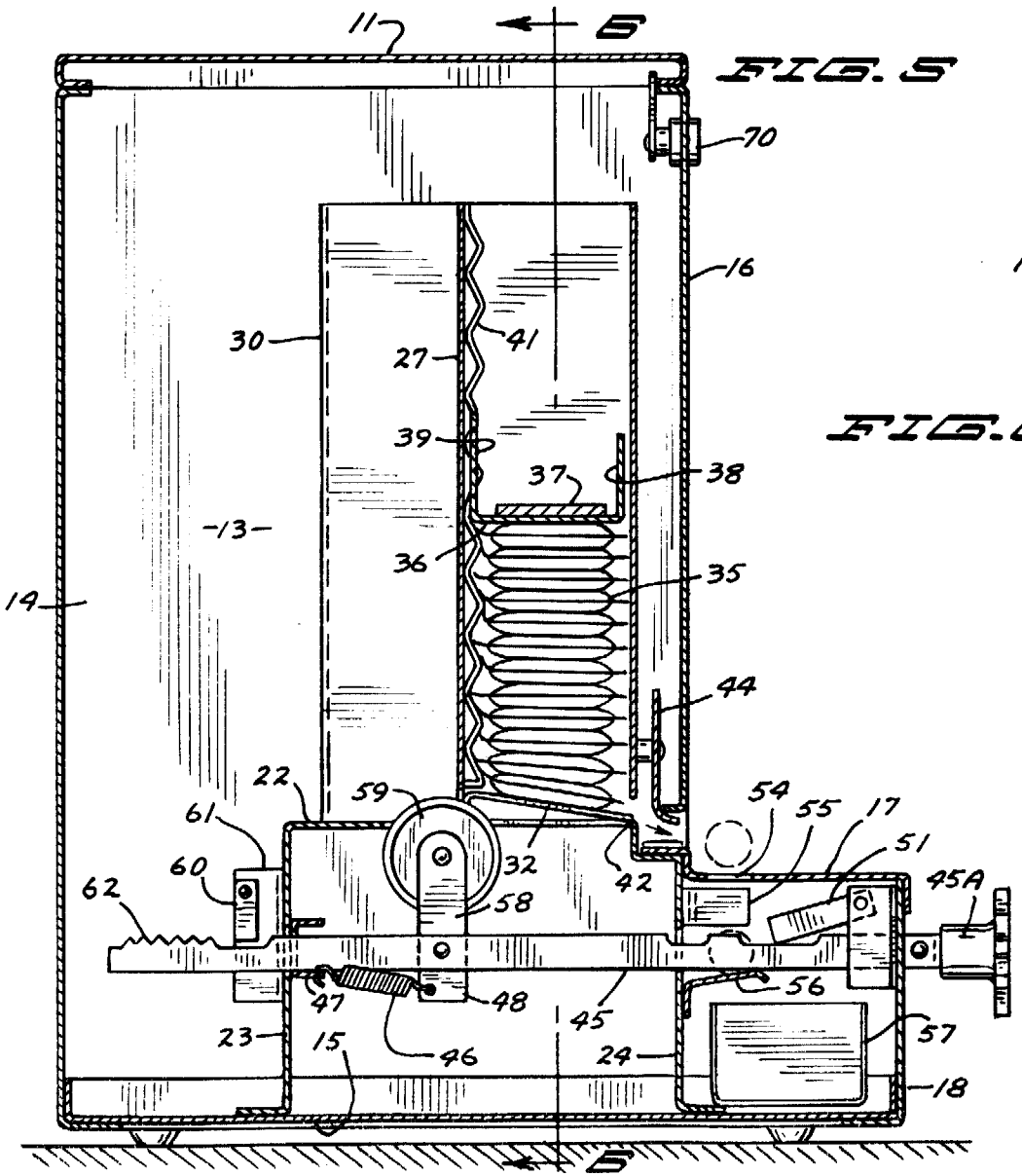
FIG. 5 is a vertical section on an enlarged scale taken on the line 5—5 of FIG. 6 and in the direction of the arrows.

DETAILED DESCRIPTION OF THE PREFERRED EMBODIMENT:

Referring now to the drawings, and particularly to FIGS. 1, 2 and 3, there is shown a packet dispensing machine 10 having a generally rectangular housing including a top wall 11, left and right end walls 12 and 13, respectively, back wall 14 and bottom wall 15, all secured together into a rigid box, and removable front panel 16. The lower front face of the housing is provided with a forwardly projecting shelf-like extension having a removable top cover plate 17, and front wall 18, right and left end walls 19 and 20, which are secured together into a rigid box and share bottom wall 15 with the remainder of the housing. The housing may be provided with feet 21 permitting the dispensing machine to rest upon a shelf or counter, or it may be hung from a wall or provided with a free-standing pedestal base support.

Within outer housing 10 there is an internal housing or frame for supporting the operating mechanism of the dispensing machine and including a top plate 22 spaced upwardly from housing bottom wall 15, rear plate 23 spaced inwardly from housing back wall 14, and front plate 24 lying generally in the plane of front panel 16 and spaced inwardly from extension front wall 18. The inner frame extends substantially the length of housing 10 and is also supported by left and right end walls 25 and 26.

A plurality of hollow vertical column packet magazines 27-30 are disposed within the housing immediately behind front panel 16 and supported on interior frame top plate 22. Each magazine is of similar structure although they may vary in size and shape, depending upon the size and shape of the packet to be dispensed. As illustrated, all of the magazines are of generally rectangular horizontal cross section but magazine 30 is adapted to receive a packet of larger size than the others.

Each magazine overlies a slot opening in the frame top plate. Referring to magazine 27, it overlies slot opening 31 whose width is less than the width of magazine 27 so as to provide a pair of ledges upon which a pair of wedges or angularly downwardly and forwardly extending ramps 32 and 33 are secured for supporting opposite sides of a packet within the magazine. The length of opening 31 is somewhat greater than the depth of magazine 27 for reasons pointed out in greater detail hereinafter. The front of the magazine preferably has a central vertical opening 34 to facilitate placement and arrangement of packets within the magazine.

The packets 35 of material to be dispensed are stacked within the magazine. To facilitate gravity feed of the packets, a flat plate 36 resting on the topmost packet carries a weight 37. Plate 36 is provided with a forward vertically and upwardly extended guide member 38 and a pair of rearward vertically and upwardly extending guide members 39 and 40 to facilitate smooth downward passage of the weight plate as it descends as the height of the column of packets diminishes.

To facilitate even gravity feed of packets 35 under the weighted member, a corrugated or saw-toothed vertical packet guide 41 is affixed to the center of the back wall of each magazine. Weight guide members 39 and 40 move on opposite sides of packet guide 41. As the packets descend, the thinner sealed edge of the packet engages a tooth of the packet guide with the result that each packet tends to remain generally horizontal in spite of the much thicker central portions of the packets.

Each magazine has a transverse horizontal discharge slot 42 at the bottommost end of the magazine front wall. A corresponding discharge slot 43 is provided in the front panel 16. A vertically adjustable packet deflector 44 is mounted on the front of each magazine adjacent the bottom end thereof. The arcuate lowermost end of the deflector plate 44 extends into discharge slot 43. The deflector plate is vertically adjustable to compensate for packets of different thicknesses.

Underlying each packet magazine and supported in the inner frame and front wall 18 is a reciprocable slide bar 45. Each slide bar has an external knob or handle 45A which is pulled outwardly to eject a packet after deposit of a coin. Slide bar 45 is spring biased for automatic return by means of coil spring 46, one end of which is secured to a channel 47 supported on the inside back frame plate 23. The outer end of spring 46 is connected to a vertical arm 48 carried by the slide bar spaced in from its rearward end.

The top edge of slide bar 45 has a shallow recess 49. One shoulder 50 of recess 49 is engageable by a locking pawl 51 pivotally supported in a vertical channel 52 supported on the inside of front wall 18. A vertical coin-receiving slot 53 extends through slide bar 45. A coin deposit slot 54 in cover plate 17 directly overlies coin-receiving slot 53 when the slide bar is in retracted position. A coin guide 55 having two vertical parallel closely spaced apart tabs secured to wall 24 immediately underlying the coin deposit slot assists in directing the coin into the coin-receiving slot. A coin support plate 56 secured to the forwardmost surface of wall 24 underlies coin-receiving slot 55 when the slide bar is in its retracted position.

When no coin is present in slot 53, the slide bar cannot be extended because locking pawl 51 engages shoulder 50 of slide bar recess 49 and prevents forward movement of the slide bar. However, when a coin is deposited in slot 54, that coin is received into slot 53 in the slide bar, the coin resting upon coin support 56. Because coin-receiving slot 53 overlaps recess 49 to a limited extent, the periphery of the coin extends into recess 49 beyond shoulder 50. With the coin in this position, when slide bar 45 is extended, the locking pawl is inoperative in that it rides up and over the peripheral edge of the coin. As the slide bar is extended, the coin is pulled forward with respect to coin support 56 and when free of the coin support drops into a coin receptacle 57.

Each packet dispensing station is designed to be operated by one size or denomination of coin, either singly or multiples of the same size coin, as determined by coin deposit slot 54. The dimensions of the coin-receiving slot 53 are coordinated with those of the coin deposit slot. If the dispensing station is designed to be operated with a single coin, then slot 53 is of length sufficient to receive one coin only. On the other hand, if the dispensing station is designed to operate with more than one coin, then slot 53 is of corresponding greater length extending rearwardly to receive two or more coins. In this instance, it is essential that the top surface of coin support plate 56 extend downwardly and rearwarly so that the first coin deposited, while retained within slot 53, rolls backwardly away from recess shoulder 50 so as not to interfere with the locking action of pawl 51. Then, when a subsequent coin is deposited, it is supported forwardly of the first coin extending above recess shoulder 50 to permit the slide bar to be pulled out without engaging the locking pawl.

The upper end of cross arm 48 carried by the slide bar is a yoke 58 supporting a friction roller 59. Roller 59 is supported for rotation by means of a one-way clutch for rotation in one direction only, as indicated. As the slide bar is extended, the friction roller is held stationary. The top periphery extends through slot 31 in the frame top plate 22 into frictional engagement with the bottommost packet in the magazine which is partially supported on wedges or ramps 32 and 33 in the bottom wall of the magazine. As the slide bar is extended, the periphery of friction roller 59 engaging the under surface of the packet urges it forward through discharge slots 42 and 43 out onto cover plate 17. Then, when the slide bar is retracted automatically by spring 46, the friction roller rotates freely relative to the now-bottommost packet in the magazine. When the slide bar is at rest, the top periphery of the friction roller is preferably out of engagement with the rearward edge of the bottommost packet which is positioned by ramps 32 and 33 to extend upwardly. The ramps direct the forward edge into the discharge slot 42 for easy dispensing on the next cycle of the dispensing station.

In order to prevent discharge of more than one packet for the payment of a single price, as might occur if the slide bar were pumped repeatedly in short strokes insufficient to cause engagement of locking pawl 51 with shoulder 50, each dispensing station is provided with a so-called "anti-jackpot" pawl 60. Pawl 60 is pivotally supported in channel 61 on the back surface of frame rear wall 23 overlying the slide bar. The top edge of slide bar 45 is provided with a plurality of ratchet teeth 62, all of which are located rearwardly of pawl 60 when the slide bar is in its fully retracted position and forward of pawl 60 when the slide bar is in its fully extended position.

In the normal operation of the machine, pawl 60 merely rides over the top edges of teeth 62 without entering into locking engagement. However, if the slide bar is permitted to be partially retracted less than full stroke and then an attempt is made to pull it out further, pawl 60 engages teeth 62 in locking engagement to prevent further extension. At the same time, the purchaser is protected against accidental loss of his money without a packet being dispensed. If the slide bar is pulled out partially and the handle slips from the purchaser's grasp before a packet is delivered, pawl 60 engages teeth 62 to prevent automatic retraction of the slide bar without delivery of a packet. A second recess or notch 63 in the top edge of the slide bar is engageable with pawl 51 to limit the extent of outward movement of the slide bar.

Figures 7, 8, 9:
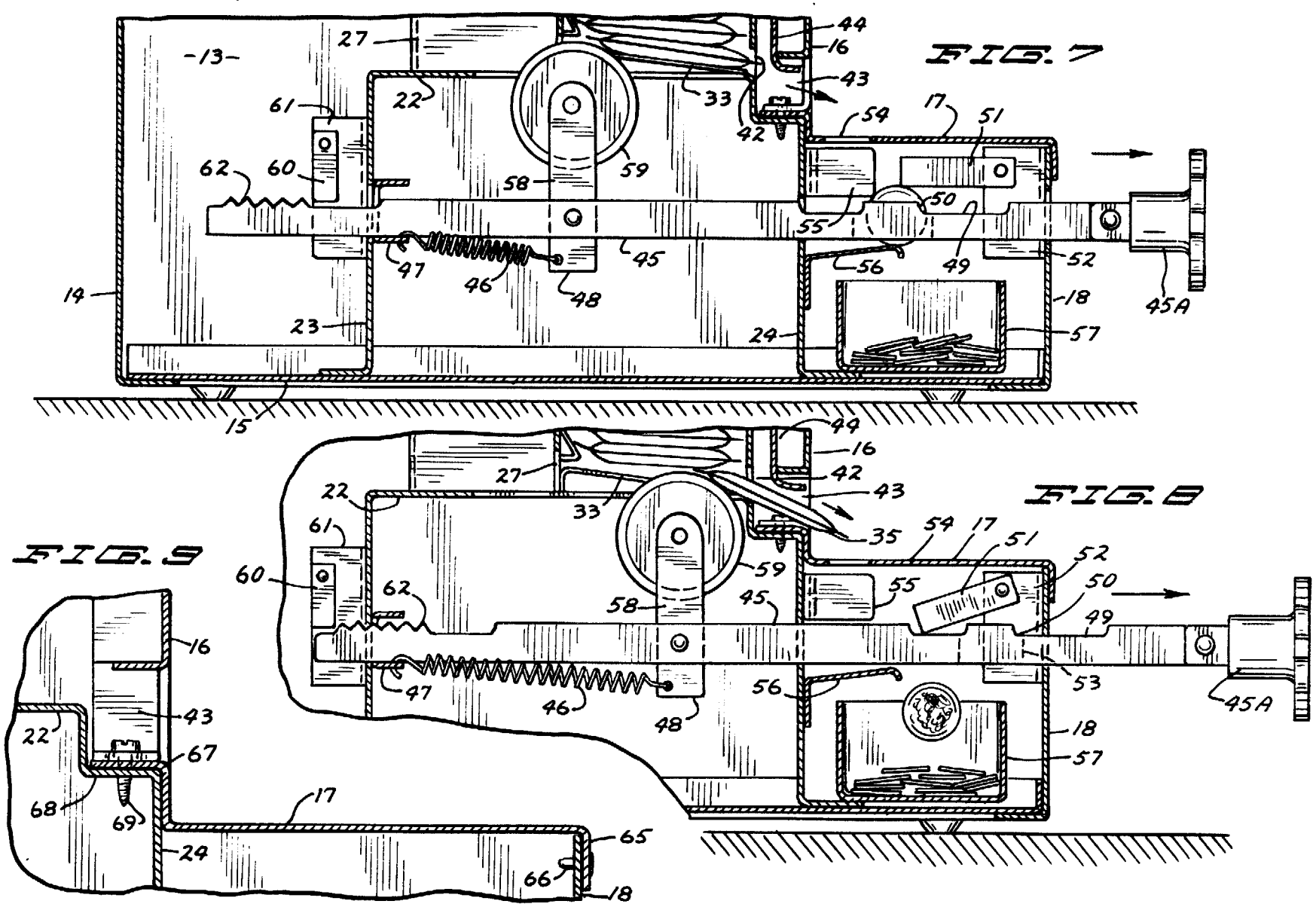
FIG. 7 is a fragmentary vertical section showing the machine in operation after deposit of a coin and partial extension of the operating slide bar.
FIG. 8 is a similar fragmentary vertical section showing the machine in a later stage of operation just short of full extension of the operating slide bar.
FIG. 9 is a fragmentary section on the line 9—9 of FIG. 2 and in the direction of the arrows, showing details of the assembly structure of the housing.

The dispensing machine according to the present invention is of simple structure. The packet magazines are readily accessible through front panel 16 and access to the coin receptacles is easily had by removal of cover plate 17. At the same time, access to the interior of the machine is controlled through a single lock. Reference is made to FIG. 9 wherein it is shown that cover plate 17 has a depending flange 65 which abuts front wall 18. One of a plurality of pins 66 affixed to flange 65 engages an opening in front wall 18 to firmly secure the cover plate in place. The inner edge of cover plate 17 has a lip 67 which engages a shoulder 68 extending along the forward edge of inner frame top plate 22. One of a plurality of pins 69 secured to the bottom edge of front panel 16 engages and extends through complementary openings in lip 67 and shoulder 68. The front panel 16 is then held in place by lock 70. Once lock 70 is opened, the front panel may be tilted forward slightly and lifted upwardly to free pins 69 and remove the front panel. Then cover plate 17 may be tilted forwardly to disengage pins 66 and remove the cover plate.

Suitable indicia are provided to identify the product being dispensed from each dispensing station and the number and denomination of coins required to operate each dispensing unit.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A coin-operated machine for dispensing generally flat semi-rigid packets of irregular contour, which machine comprises:

(A) a housing, (B) at least one vertically disposed column packet magazine disposed within said housing for holding a plurality of packets in stacked relation for gravity feed operation, said magazine including:

(1) a vertically extending saw-toothed packet guide on the inside back wall, (2) a horizontal packet discharge slot adjacent the bottom thereof, and (3) bottom walls on opposite sides of said slot extending angularly downwardly and forwardly to the discharge slot, (C) a complementary horizontal packet discharge slot in said housing adjacent said magazine slot, (D) a central slot in the bottom wall of said magazine and a spring biased slide bar supported within said housing under said central slot for relative reciprocal movement from a retracted to an extending position, the upper edge of the rearward end of said slide bar including a plurality of ratchet teeth, (E) handle means on said bar external of said housing for reciprocating said bar, (F) a coin deposit slot in said housing overlying said slide bar, (G) a vertically disposed coin-receiving slot extending through the slide bar and underlying said coin deposit slot, (H) a fixed coin support underlying said coin-receiving slot when said slide bar is in retracted position, (I) a recess in the upper edge of said slide bar adjacent said coin-receiving slot, (J) a first locking pawl pivotally supported within said housing, said pawl being engageable with said recess upon reciprocation of the slide bar with no coin in the coin-receiving slot, and a further locking pawl pivotally supported within said housing immediately forwardly of said ratchet teeth when said slide bar is in retracted position, said pawl being engageable with said ratchet teeth upon less than full stroke reciprocation of said slide bar, and (K) friction means movable with said slide bar under said magazine in a path extending into the central slot in the bottom end of the magazine for frictional engagement with the lowermost packet in the magazine to remove that packet through the discharge slot.

2. A machine according to claim 1 further characterized in that said magazine includes weight means adapted to be disposed on top of the topmost packet in the magazine, said weight means being of configuration corresponding to the cross sectional configuration of the magazine and adapted for loose sliding movement therein, and said weight means including vertically and upwardly extending guide means.

3. A machine according to claim 1 further characterized in that said friction means comprises a friction roller.

4. A machine according to claim 3 further characterized in that said friction roller is associated with a one-way clutch whereby said roller is fixed against rotation when said slide bar is extended and said roller rotates in engagement with the lowermost packet in said magazine upon retraction of said slide bar.

5. A machine according to claim 1 further characterized in that:

(A) said coin-receiving slot in said slide bar is of length extending rearwardly from said recess to receive a plurality of coins of the same denomination, and (B) said coin support is of corresponding width to support a plurality of coins of the same denomination and extends angularly downwardly and rearwardly.

6. A machine according to claim 1 further characterized in that a further recess is provided in the upper edge of said slide bar spaced rearwardly from said first recess, said further recess being engageable with said first locking pawl to limit extension of said slide bar.

* * * * *